US007210430B2

(12) United States Patent
Jacobsen et al.

(10) Patent No.: US 7,210,430 B2
(45) Date of Patent: May 1, 2007

(54) RAPID RESPONSE POWER CONVERSION DEVICE

(75) Inventors: Stephen C. Jacobsen, Salt Lake City, UT (US); Marc Olivier, Sandy, UT (US); Michael Morrison, West Jordan, UT (US); Shane Olsen, Centerville, UT (US)

(73) Assignee: Sarcos Investments LC, Salt Lake City, UT (US)

( * ) Notice: Subject to any disclaimer, the term of this patent is extended or adjusted under 35 U.S.C. 154(b) by 0 days.

(21) Appl. No.: 11/259,365

(22) Filed: Oct. 25, 2005

(65) Prior Publication Data

US 2006/0070590 A1 Apr. 6, 2006

Related U.S. Application Data

(62) Division of application No. 10/190,336, filed on Jul. 5, 2002, now Pat. No. 6,957,631.

(60) Provisional application No. 60/303,053, filed on Jul. 5, 2001.

(51) Int. Cl.
*F02B 71/04* (2006.01)
*F02B 75/04* (2006.01)

(52) U.S. Cl. ..... 123/46 R

(58) Field of Classification Search ..... 123/46 R, 123/46 A, 46 B, 46 SC, 46 E, 46 H, 51 R, 123/51 BA See application file for complete search history.

(56) References Cited

U.S. PATENT DOCUMENTS 179,782 A 7/1876 Gilles
1,711,906 A * 5/1929 Sands ..... 123/66
2,816,416 A 12/1957 French
3,170,406 A 2/1965 Robertson
3,234,395 A 2/1966 Colgate
3,274,946 A 9/1966 Simmons
3,604,204 A 9/1971 Conrad
3,868,931 A 3/1975 Dutry et al.
3,918,851 A 11/1975 Fitzgerald (Continued)

FOREIGN PATENT DOCUMENTS

DE 3410491 9/1985

(Continued)

*Primary Examiner*—Stephen K. Cronin
*Assistant Examiner*—Hyder Ali
(74) *Attorney, Agent, or Firm*—Thorpe North & Western LLP

(57) ABSTRACT

An apparatus and method for extracting energy from an internal combustion engine. The internal combustion engine includes a chamber having a primary piston and a secondary piston with a combustion portion of the chamber situated adjacently between the primary piston and secondary piston. The secondary piston includes a substantially lesser mass than that of the primary piston. The chamber includes at least one fluid port for supplying fuel to the combustion portion and an out-take port for releasing combustive exhaust. The chamber includes a controller for controlling the combustion therein at selected cycles of the primary piston. With this arrangement, the secondary piston is configured to draw a portion of energy from combustion controlled by the controller in the chamber. Such portion of energy is provided with a rapid response to an energy transferring portion interconnected to the secondary piston, which in turn, transfers and/or converts the energy for acting on a load or external application.

16 Claims, 8 Drawing Sheets

U.S. PATENT DOCUMENTS

| | | | |
|---|---|---|---|
| 4,090,479 | A | 5/1978 | Kaye |
| 4,167,922 | A | 9/1979 | Doundoulakis |
| 4,306,680 | A | 12/1981 | Smith |
| 4,554,943 | A | 11/1985 | Claney et al. |
| 4,599,983 | A | 7/1986 | Omachi |
| 4,907,549 | A | 3/1990 | Morikawa et al. |
| 5,109,810 | A | 5/1992 | Christenson |
| 5,261,797 | A | 11/1993 | Christenson |
| 5,685,215 | A | 11/1997 | Jepsen et al. |
| 5,894,730 | A | 4/1999 | Mitchell |
| 6,029,616 | A | 2/2000 | Mayne et al. |
| 6,241,488 | B1 | 6/2001 | Luoto |
| 6,244,226 | B1 | 6/2001 | Berlinger et al. |
| 6,626,650 | B1 | 9/2003 | Kenchington et al. |
| 6,957,631 | B2 | 10/2005 | Jacobsen et al. |

FOREIGN PATENT DOCUMENTS

| | | |
|---|---|---|
| FR | 527 395 | 12/1913 |
| GB | 2003548 | 9/1979 |

* cited by examiner

RAPID RESPONSE POWER CONVERSION DEVICE

SPECIFICATION

This divisional application claims the benefit of application Ser. No. 10/190,336 filed Jul. 5, 2002 now U.S. Pat. No. 6,957,631 in the United States Patent Office which claims the benefit of application Ser. No. 60/303,053 filed Jul. 5, 2001.

BACKGROUND OF THE INVENTION

1. Field of the Invention

The present invention relates generally to internal combustion engines. More specifically, the present invention relates to an apparatus and method of extracting energy during combustion in an internal combustion engine.

2. Related Art

Primary power sources that directly convert fuel into usable energy have been used for many years in a variety of applications including motor vehicles, electric generators, hydraulic pumps, etc. Perhaps the best known example of a primary power source is the internal combustion engine, which converts fossil fuel into rotational power. Internal combustion engines are used by almost all motorized vehicles and many other energetically autonomous devices such as lawn mowers, chain saws, and emergency electric generators. Converting fossil fuels into usable energy is also accomplished in large electricity plants, which supply electric power to power grids accessed by thousands of individual users. While primary power sources have been successfully used to perform these functions, they have not been successfully used independently in many applications because of their relatively slow response characteristics. This limitation is particularly problematic in powering robotic devices and similar systems which utilize a feedback loop which makes real time adjustments in movements of the mechanical structure. Typically, the power source in such a system must be able to generate power output which quickly applies corrective signals to power output as necessary to maintain proper operation of the mechanical device.

The response speed of a power source within a mechanical system, sometimes referred to as bandwidth, is an indication of how quickly the energy produced by the source can be accessed by an application. An example of a rapid response power system is a hydraulic pressure system. In a hydraulic system, energy from any number of sources can be used to pressurize hydraulic fluid and store the pressurized fluid in an accumulator. The energy contained in the pressurized fluid can be accessed almost instantaneously by opening a valve in the system and releasing the fluid to perform some kind of work, such as extending or retracting a hydraulic actuator. The response time of this type of hydraulic system is very rapid, on the order of a few milliseconds or less.

An example of a relatively slow response power supply system is an internal combustion engine. The accelerator on a vehicle equipped with an internal combustion engine controls the rotational speed of the engine, measured in rotations per minute ("rpms"). When power is desired the accelerator is activated and the engine increases its rotational speed accordingly. But the engine cannot reach the desired change in a very rapid fashion due to inertial forces internal to the engine and the nature of the combustion process. If the maximum rotational output of an engine is 7000 rpms, then the time it takes for the engine to go from 0 to 7000 rpms is a measure of the response time of the engine, which can be a few seconds or more. Moreover, if it is attempted to operate the engine repeatedly in a rapid cycle from 0 to 7000 rpms and back to 0 rpms, the response time of the engine slows even further as the engine attempts to respond to the cyclic signal. In contrast, a hydraulic cylinder can be actuated in a matter of milliseconds or less, and can be operated in a rapid cycle without compromising its fast response time.

For this reason, many applications utilizing slow response mechanisms require the energy produced by a primary power source be stored in another, more rapid response energy system which holds energy in reserve so that the energy can be accessed instantaneously. One example of such an application is heavy earth moving equipment, such as backhoes and front end loaders, which utilize the hydraulic pressure system discussed above. Heavy equipment is generally powered by an internal combustion engine, usually a diesel engine, which supplies ample power for the operation of the equipment, but is incapable of meeting the energy response requirements of the various components. By storing and amplifying the power from the internal combustion engine in the hydraulic system, the heavy equipment is capable of producing great force with very accurate control. However, this versatility comes at a cost. In order for a system to be energetically autonomous and be capable of precise control, more components must be added to the system, increasing weight and cost of operation of the system.

Another example of a rapid response power supply is an electrical supply grid or electric storage device such as a battery. The power available in the power supply grid or battery can be accessed as quickly as a switch can be opened or closed. A myriad of motors and other applications have been developed to utilize such electric power sources. Stationary applications that can be connected to the power grid can utilize direct electrical input from the generating source. However, in order to use electric power in a system without tethering the system to the power grid, the system must be configured to use energy storage devices such as batteries, which can be very large and heavy. As modern technology moves into miniaturization of devices, the extra weight and volume of the power source and its attendant conversion hardware are becoming major hurdles against meaningful progress.

The complications inherent in using a primary power source to power a rapid response source become increasingly problematic in applications such as robotics. In order for a robot to accurately mimic human movements, the robot must be capable of making precise, controlled, and timely movements. This level of control requires a rapid response system such as the hydraulic or electric systems discussed above. Because these rapid response systems require power from some primary power source, the robot must either be part of a larger system that supplies power to the rapid response system or the robot must be directly fitted with heavy primary power sources or electric storage devices. Ideally, however, robots and other applications should have minimal weight, and should be energetically autonomous, not tethered to a power source with hydraulic or electric supply lines. To date, however, technology has struggled to realize this combination of rapid response, minimal weight, effective control, and autonomy of operation.

SUMMARY OF THE INVENTION

The present invention relates to an apparatus and method for extracting a portion of energy from the energy created during combustion in an internal combustion engine. The present invention is directed to extracting a portion of energy during an optimal time period of combustion and providing superior bandwidth characteristics to the engine.

The present invention includes a chamber having a primary piston, a rapid response component and a controller operably interconnected to the chamber. The chamber also includes at least one fluid port for supplying fluid thereto and an out-take port. The primary piston in combination with the fluid port is configured to provide a variable pressure to the chamber and at least partially facilitate combustion to create energy in a combustion portion of the chamber. The primary piston is configured to reciprocate in the chamber. The controller is configured to control the combustion in the chamber. The rapid response component is in fluid communication with the chamber so that the rapid response component is situated adjacent the combustion portion of the chamber. According to the present invention, the rapid response component is configured to draw a portion of the energy from the combustion in the chamber.

One aspect of the present invention provides that the portion of energy drawn from the combustion by the rapid response component is drawn from a proximate instant of the combustion and prior to the primary piston being positioned at a median between a top dead center position and a bottom dead center position in the chamber. Furthermore, the rapid response component draws at least 90% of the portion of the energy from the chamber within 45 degrees of the primary piston descending from the top dead center position. As such, a majority of the portion of energy extracted by the rapid response component is completed relatively long before the energy primary piston completes a reciprocation cycle.

The rapid response component includes a secondary piston having an energy receiving portion. The secondary piston is interconnected to an energy transferring portion, wherein the energy receiving portion of the secondary piston is configured to draw the portion of the energy from the combustion and transfer such energy to the energy transferring portion of the rapid response component. At the energy transferring portion, the portion of energy extracted from the combustion is converted to any one of hydraulic energy, pneumatic energy, electric energy and mechanical energy.

Another aspect of the present invention provides that as the linear movement of the primary piston between the top and dead center positions is always substantially constant, the linear movement of the secondary piston is variable in length. Such variable length is determined by at least a load to which the portion of the energy is acting upon. Furthermore, the mass of the primary piston is greater than the mass of the secondary piston such that a first effective inertia of the primary piston is greater than the second effective inertia of the secondary piston by a ratio of at least 5:1. Such ratio is the case at least during the time in which the portion of energy is being extracted to the secondary piston.

The controller is configured to control combustion in the chamber. In particular, depending on the load and/or requirements of the internal combustion engine, the controller is configured to control and select particular cycles for initiating combustion out of the substantially continuously, repeating cycles of the primary piston reciprocating in the chamber. As such, the controller is configured to control the energy extracted by the secondary piston to provide an impulse modulation and/or amplitude modulation of energy. As such, the ability to select particular cycles and, thus, the ability to rapidly provide energy and terminate the energy from cycle to cycle provides superior bandwidth than the bandwidth provided from the primary piston.

In a second embodiment, the chamber includes a first compartment and a second compartment with a divider portion dividing the compartments and an aperture defined in the divider portion and extending between the first and second compartments. With this arrangement, the fluid is compressed by the primary piston from the first compartment to the second compartment through the aperture, wherein the controller ignites the compressed fluid in the second compartment. In the second embodiment, the combustion is at least partially isolated from the primary piston.

In a third embodiment, the present invention is directed to a rapid response component associated with a non-combustion system. In this system, a reactive member, such as a catalyst, is positioned in the chamber. The reactive member is positioned in the chamber and configured to receive a fluid, such as a monopropellant or hydrogen peroxide, to produce a non-combustive reaction which provides energy and a variable pressure to the chamber for reciprocating the primary piston. The controller is configured to control the non-combustive reaction by controlling the fluid entering the chamber. The rapid response component is situated adjacent a portion of the chamber having the non-combustive reaction so that the rapid response component is configured to draw and extract a portion of the energy for the non-combustive reaction.

DETAILED DESCRIPTION

Figure 1:
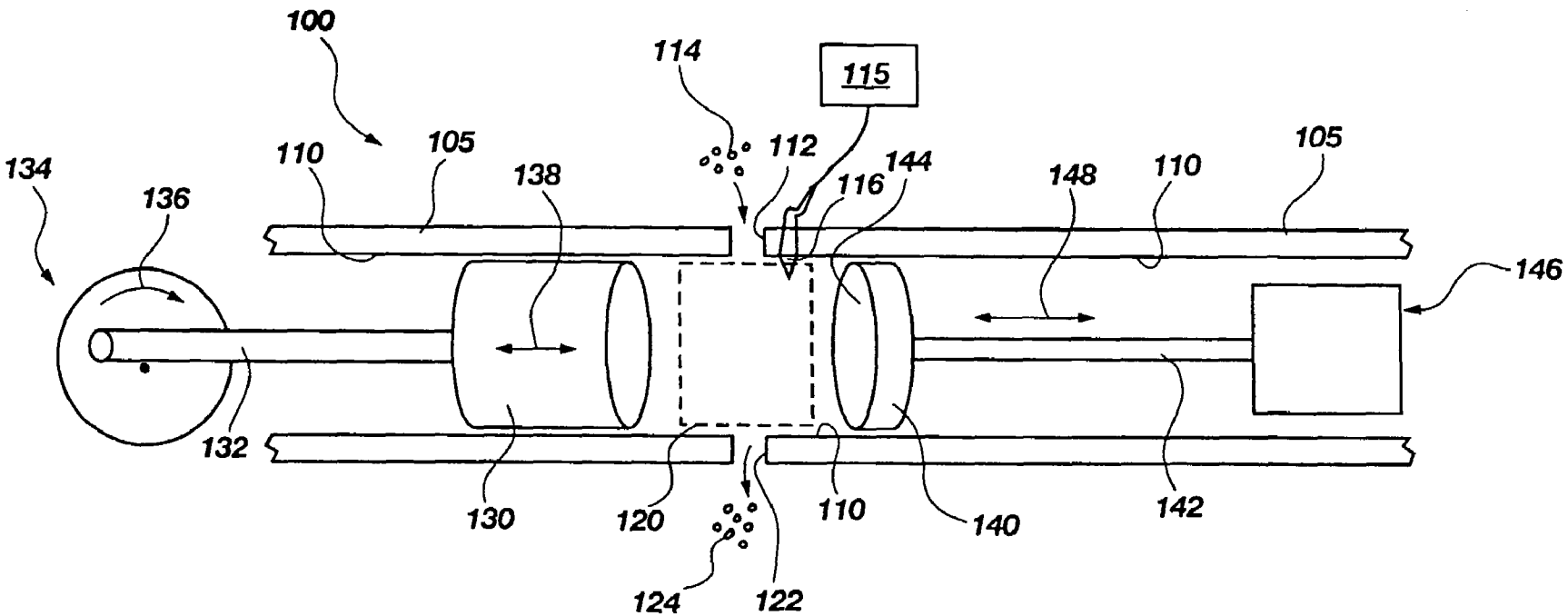
FIG. 1 illustrates is a schematic side view of a rapid response energy extracting system, depicting a chamber having a primary piston and a secondary piston, according to a first embodiment of the present invention.

For the purposes of promoting an understanding of the principles of the present invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Referring first to FIG. 1, a simplified schematic view of a rapid response energy extracting system 100 is illustrated. Such a system 100 may partially include a typical internal combustion ("IC") engine, such as a four stroke spark ignition IC engine. Other types of engines may also be utilized with the present invention, such as compression ignition IC engines, two stroke IC engines, non-combustion engines or any other suitable engine. For purposes of simplicity, rapid response energy extracting system 100 is illustrated here in conjunction with a typical four stroke spark ignition IC engine, wherein a single chamber 110 is depicted with the present invention.

The chamber 110 is defined by chamber walls 105 and includes one or more intake ports 112 for receiving a fuel 114 and an oxidizer such as air or oxygen, separately or as a mixture, and an out-take port 122 for releasing combustive exhaust gases 124. Each of the intake port 112 and the out-take port 122 includes a valve (not shown), which are each configured to open and close at specified times to allow fuel 114 and exhaust 124 to enter and exit the chamber 110, respectively. The chamber 110 includes a primary piston 130, a secondary piston 140 and a combustion portion 120 therebetween. The primary piston 130 is interconnected to a piston rod 132, which in turn is interconnected to a crank shaft 134. The primary piston 130 is sized and configured to move linearly within the chamber 110 for converting linear movement 138 from the primary piston 130 to the crank shaft 134 into rotational energy 136. Such rotational energy 136 may be used to power a wide range of external applications, such as any type of application that typically utilizes an IC combustion engine.

The linear movement 138 of the primary piston 130 takes place between a top dead center ("TDC") position and a bottom dead center ("BDC") position. The TDC position occurs when the piston 130 has moved to its location furthest from the crank shaft 134 and the BDC position occurs when the primary piston 130 has moved to its location closest to the crank shaft 134. The linear movement of the primary piston 130 between the TDC position and the BDC position may be generated by cyclic combustion in the combustion portion 120 of the chamber 110. Primary piston 130 may also move linearally within chamber 110 by other suitable means, such as electric energy from a battery.

A four stroke cycle of an IC engine begins with the piston 130 located at TDC. As the piston 130 moves toward BDC, a fuel 114 is introduced into the chamber 110 through intake port 112, which may include one or more openings and may also be a variable opening for varying the flow and amount of fuel 114 into the chamber 110. Once the fuel 114 enters the chamber 110, the intake port 112 is closed and the piston 130 returns toward TDC, compressing the fuel 114 in the chamber 110. An ignition source 116, controlled by a controller 115, supplies a spark at which point the compressed fuel combusts and drives the piston 130 back to BDC. As the piston 130 returns again toward TDC, combustive exhaust gases 124 are forced through out-take port 122. The out-take port 122 is then closed, and intake port 112 is opened, and the four stroke cycle may begin again. In this manner, a series of combustion cycles powers the crank shaft 134, which provides rotational energy 136 to an external application.

According to the present invention, chamber 110 also includes a secondary piston 140 having a secondary piston rod 142 extending therefrom. The secondary piston 140 includes a face, or energy receiving end 144, and the secondary piston rod 142 is coupled to an energy transferring portion 146. The energy receiving end 144 may be positioned in chamber 110 to face primary piston 130 so that the longitudinal movement of the primary piston 130 and the secondary piston 140 corresponds with a longitudinal axis of chamber 110. In an inactive position, the energy receiving end 144 of the secondary piston 140 may be biased in a substantially sealing position against a lip or some other suitable sealing means, biased by a spring or by another suitable biasing force, such as a pressure reservoir, so that the secondary piston 140 is biasingly positioned prior to introducing fuel into the combustion chamber 110 or prior to combustion during cyclic combustion of the system 100.

One important aspect of the present invention is that the secondary piston 140 includes a substantially lower mass than that of the primary piston 130. Such a substantially lower mass positioned adjacent the combustion portion 120 of the chamber 110 facilitates a rapid response to combustion, which provides linear movement 148 along the longitudinal axis of the chamber 110 to the secondary piston 140. Because the mass of the secondary piston 140 is much lower than a mass of the primary piston 130, the secondary piston 140 can efficiently extract a large fraction of the energy created by the combustion before it is otherwise lost to inefficiencies inherent in IC engines. With this arrangement, the energy receiving end 144 of the secondary piston 140 is sized, positioned and configured to react to combustion in the chamber 110 so as to provide linear movement 148 to the energy receiving end 144 to then act upon the energy transferring portion 146 of the system 100.

Figure 2:
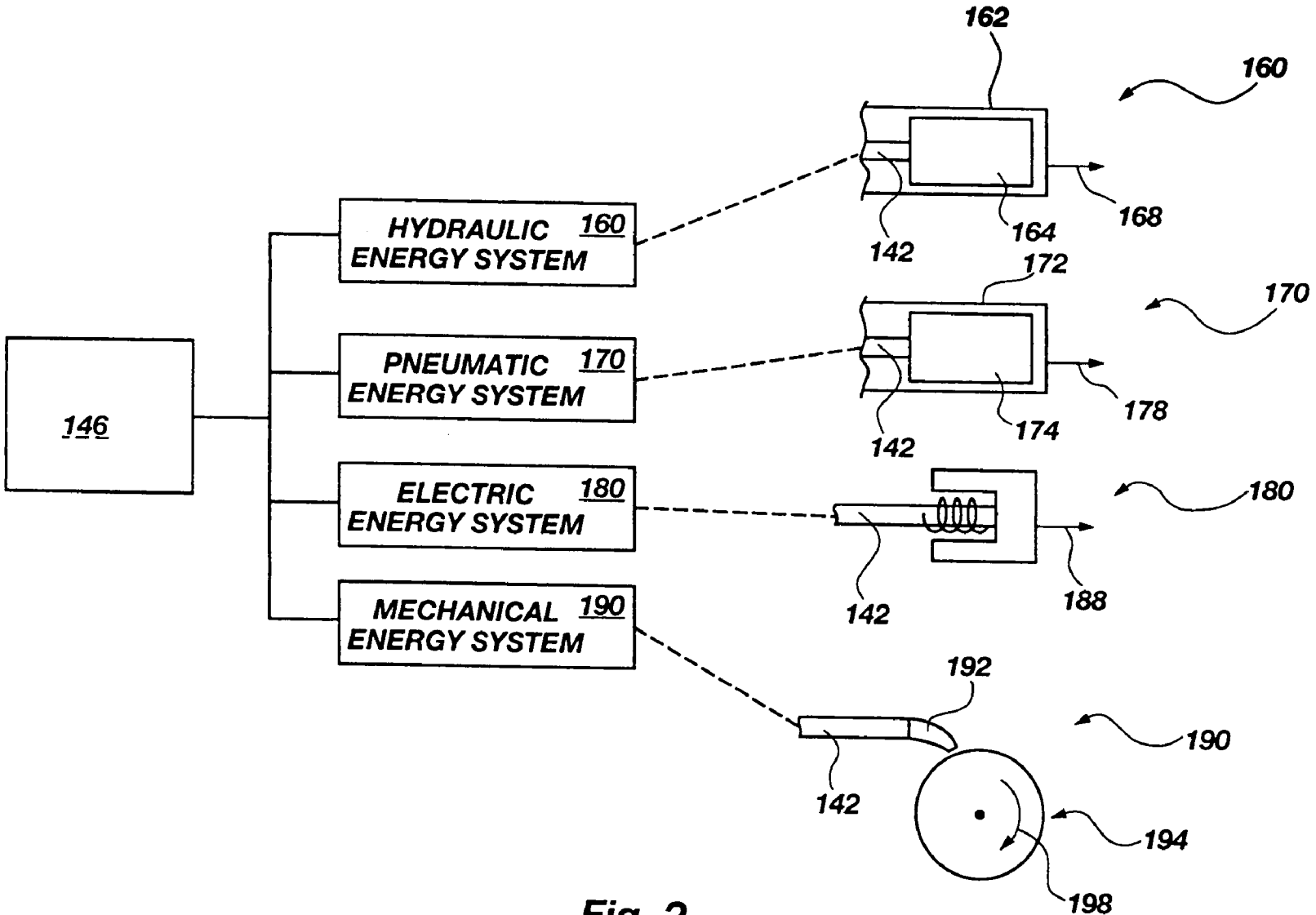
FIG. 2 illustrates a block diagram associated with various partial schematic side views, depicting various forms of energy transfer through an energy transfer portion of the rapid response energy extracting system, according to the first embodiment of the present invention.

Referring now to FIG. 2, the energy transferring portion 146 may include and/or may be coupled with any number of energy conversion devices. In particular, the energy transferring portion 146 is configured to transfer the linear movement of the secondary piston 140 to any one of hydraulic energy, pneumatic energy, electric energy and/or mechanical energy. Transferring linear motion into such various types of energy is well known in the art.

For example, in a hydraulic system 160, linear motion via the secondary piston rod 142 transferred to a hydraulic piston 164 in a hydraulic chamber 162 may provide hydraulic pressure 168, as well known in the art. Similarly, in a pneumatic system 170, the secondary piston rod 142 may provide linear motion to a pneumatic piston 174 in a pneumatic chamber 162 to provide output energy in the form of pneumatic pressure.

Other systems may include an electrical system 180 and a mechanical system 190. As well known in the art, in an electrical system 180, the linear motion of secondary piston rod 142 may be interconnected to an armature with a coil wrapped therearound, wherein the armature reciprocates in the coil to generate an electrical energy output 188. Furthermore, in the mechanical system, linear motion from secondary piston rod 142 may be transferred to rotational energy 198 with a pawl 192 pushing on a crank shaft 194 to provide rotational energy 198. Additionally, the secondary piston rod 142 may be directly interconnected to the crank shaft 194 to provide the rotational energy 198. Other methods of converting energy will be apparent to those skilled in the art. For example, rotational electric generators, gear driven systems, and belt driven systems can be utilized by the energy transferring portion 146 the present invention.

Figure 3:
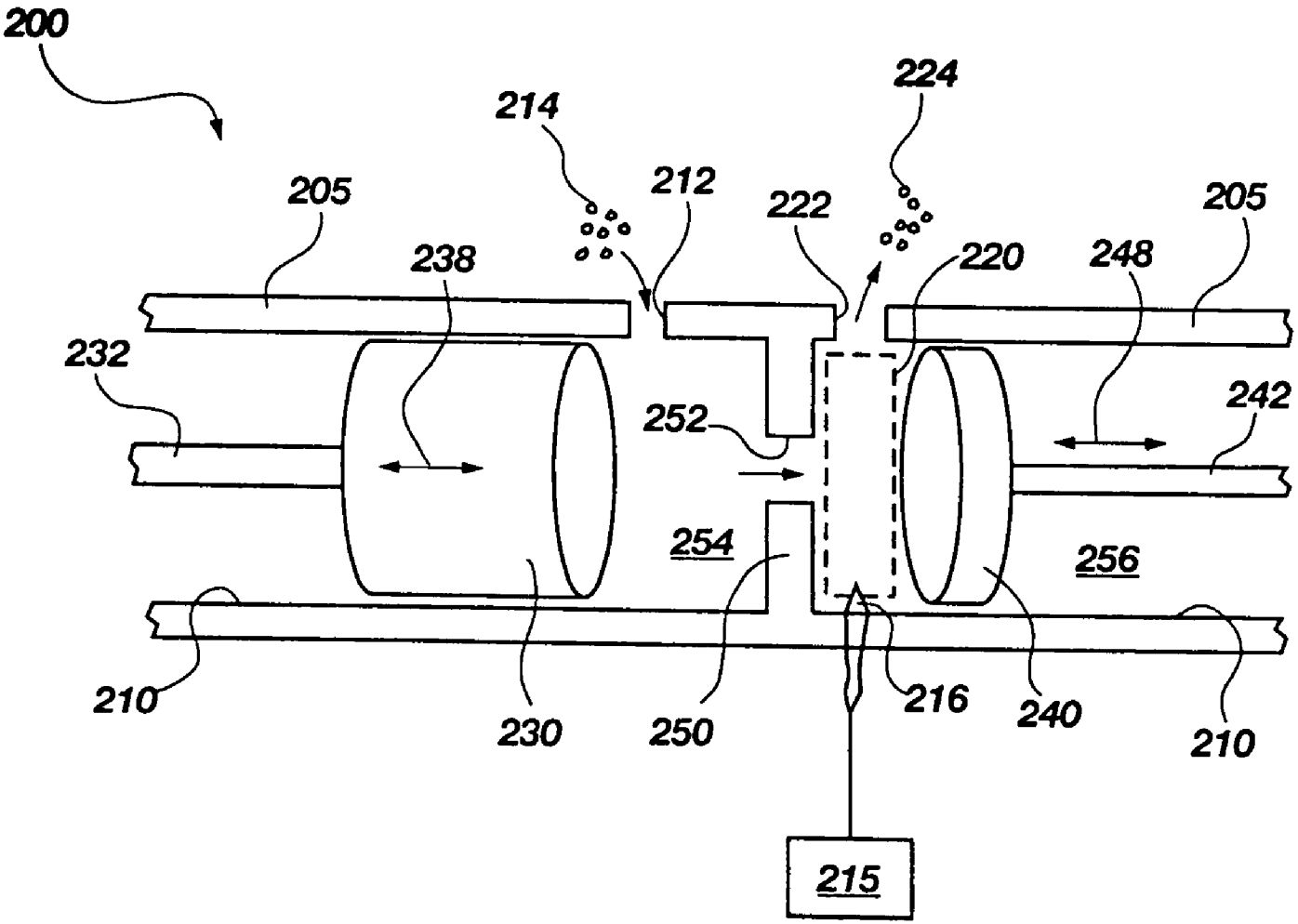
FIG. 3 illustrates a partial schematic side view of the rapid response energy extracting system, depicting a chamber having multiple compartments, according to a second embodiment of the present invention.

Referring now to FIG. 3, there is illustrated a second embodiment of the rapid response energy extracting system 200. The second embodiment is similar to the first embodiment, except the chamber 210 defines a first compartment 254 and a second compartment 256 with a divider portion 250 disposed therebetween. The divider portion 250 defines an aperture 252 therein, which aperture 252 extends between the first compartment 254 and the second compartment 256. With this arrangement, the primary piston 230 is positioned in the first compartment 254 and the secondary piston 240 is positioned in the second compartment 256. The intake port 212 allows fuel 214 to enter the first compartment 254. The fuel 214 is pushed through the aperture 252 from the first compartment 254 into the second compartment 256 via the primary piston 230. The fuel 214 is compressed at a combustion portion 220 of the chamber 210, which is directly adjacent the secondary piston 240. An ignition source 216 then fires the fuel for combustion, wherein the secondary piston 240 moves linearally, as indicated by arrow 248, with a rapid response to the combustion. The combustive exhaust 224 then exits through the out-take port 222.

In the second embodiment, the primary piston 230 may reciprocate via combustion or an electric power source to push the fuel 214 from the first compartment to the second compartment of chamber 210. By having a divider portion 250, the combustion at the combustion portion 220 of the chamber 210 can be at least partially, or even totally, isolated from the primary piston 230. Depending on the requirements of the system 200, the controller 215 may be configured to open or close aperture 252 at varying degrees to isolate combustion from the primary piston 230. As such, in the instance of total isolation, a maximum amount of energy to the secondary piston 240 may be transferred by a rapid response to combustion.

Figure 4:
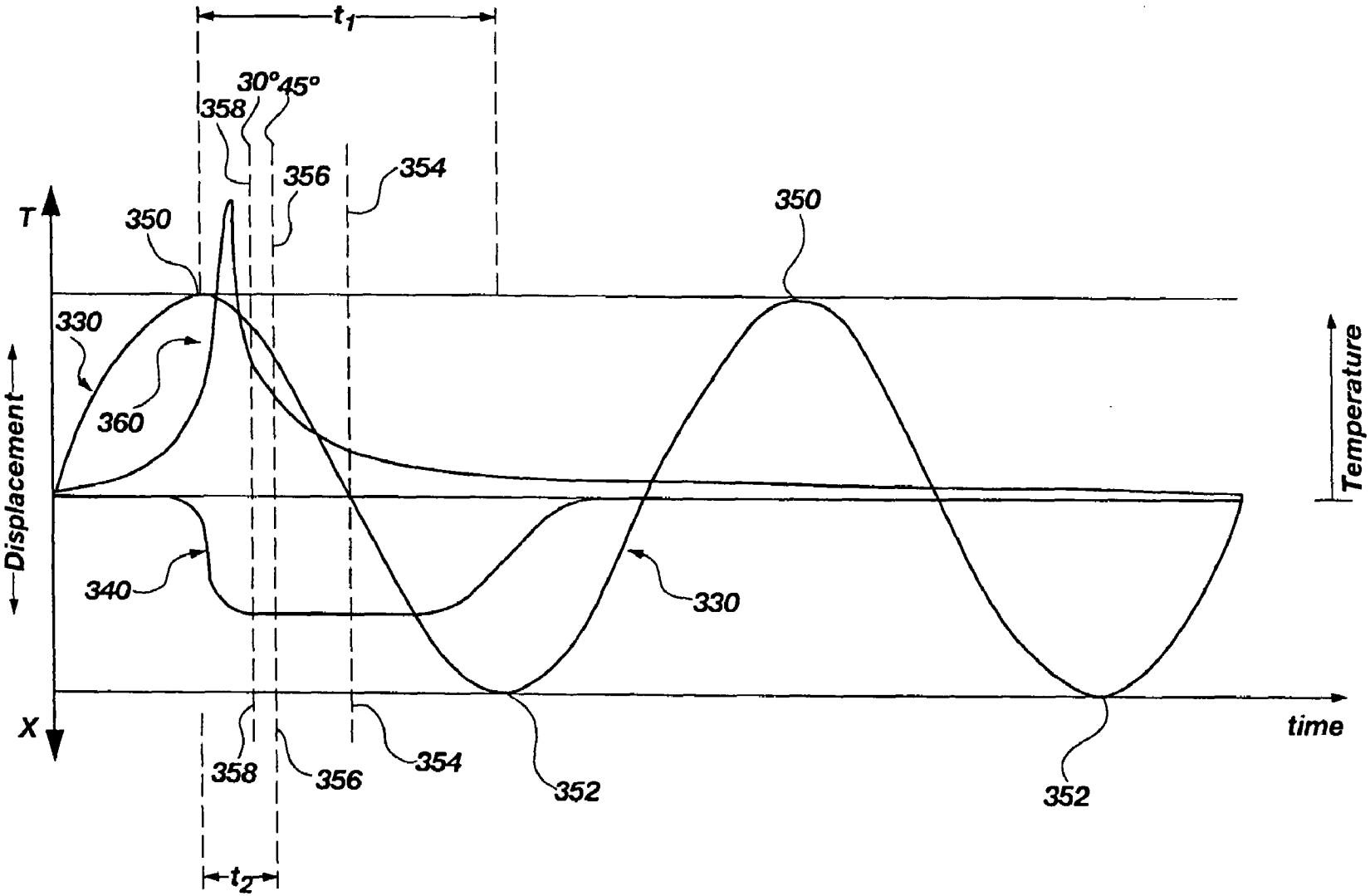
FIG. 4 illustrates a graphical representation of physical response characteristics of the primary piston with respect to the secondary piston in terms of time, temperature and displacement of the primary and secondary pistons, according to the present invention.

Referring now to FIGS. 1 and 4, a graphical diagram of the physical response characteristics of the secondary piston 140 with respect to the primary piston 130 is illustrated. Line 330 represents the linear movement 138 of the primary piston 130, reciprocating between the TDC 350 and the BDC 352 positions thereof. Line 330 illustrates one complete cycle, for a four cycle IC engine, in which the primary piston 130 travels between the TDC 350 and the BDC 352 positions twice, with one combustion event occurring immediately after the primary piston 130 reaches TDC the first time. Line 340 illustrates the linear displacement of the secondary piston 140. As indicated, the secondary piston 140 reaches substantially full displacement within at least 45 degrees, and even up to 30 degrees, of the primary piston 140 descending from TDC 350, wherein the secondary piston 140 completes one cycle much more rapidly than does the primary piston 130.

Turning now to line 360, a relative indication of the temperature rise and fall in the chamber 110 due to combustion and heat loss, respectively, with respect to the linear positions of the primary piston 130 and the secondary piston 140 is shown. Immediately after ignition of the fuel 114, when the primary piston 130 is proximate the TDC 350 position, combustion facilitates a dramatic increase in temperature. As well known, IC engines are designed to convert the thermal energy created by combustion into linear movement of the primary piston, which is in turn converted into rotational energy in the drive shaft. However, much of the thermal energy created in conventional internal combustion engines is lost due to heat escaping into the engine walls surrounding the combustion chamber and in exhaust gases. Even the most efficient internal combustion engines rarely reach efficiency rates of more than 35%. Consequently, more than half of the energy available from the combusted fuel is lost in the form of heat through the walls and piston via conduction and radiation.

The heat rise and heat loss illustrated by the rising and dropping line 360, representing combustion, depicts the time during which energy is available in the form of thermal energy and the time in which the primary piston 130 should be extracting the thermal energy. Time $t_2$ indicates the time period during which a majority of the thermal energy is available for conversion by the primary piston. Time $t_1$ indicates the time period during which the primary piston 130 is moving from the TDC 350 to BDC 352 positions. It is during the period $t_1$ that the primary piston 130 should be converting energy from the combustion process. As indicated by the difference between the two time periods $t_1$ and $t_2$, most of the thermal energy from the combustion escapes prior to the primary piston 130 reaching a median 354 of its travel between the TDC 350 to BDC 352 positions.

However, according to the present invention, the secondary piston 140 substantially completes its useful energy extraction cycle before the expiration of time period $t_2$. Because the secondary piston 140 moves much more rapidly than does the primary piston 130, it can convert a much greater percentage of the thermal energy into linear motion before the thermal energy is lost to the heat sink formed by the walls, primary piston, and other components of the IC engine. Additionally, because the secondary piston 140 acts independently of the primary piston 130 and because the secondary piston 140 has a substantially lower mass than the primary piston, the secondary piston reacts to combustion with a very rapid response time.

For example, an IC engine having operating characteristics running at 3000 revolutions per minute, $t_1$ would be approximately 10 milliseconds, or 0.010 seconds, and $t_2$ would be approximately 3 milliseconds. Because the secondary piston 140 can be operated independently of the primary piston 130, the secondary piston 140 can be operated with a response time of approximately 3 milliseconds or potentially even at a shorter response time. In other words, the secondary piston 140 can both begin and stop extracting energy from the combustion cycles of the system 100 within at least a 3 millisecond time period. Faster response times can be achieved by operating the primary piston 130 at a higher rpm state.

Figure 5:
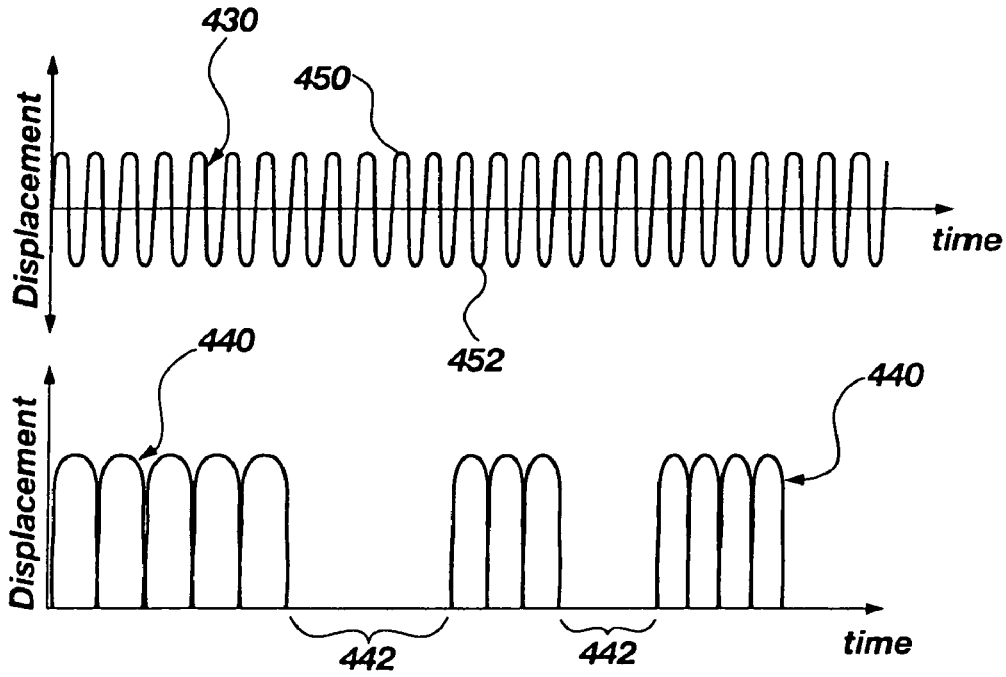
FIG. 5 illustrates a graphical representation of the physical response characteristics of the primary piston with respect to the secondary piston, depicting impulse modulation of the secondary piston, according to the present invention.
Figure 6:
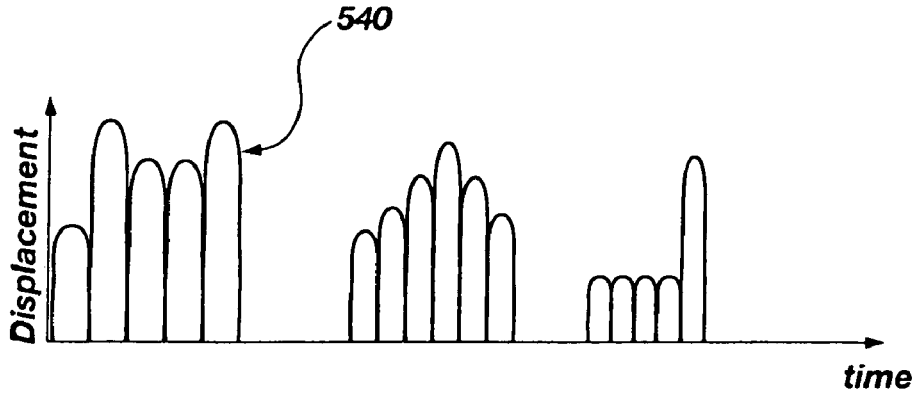
FIG. 6 illustrates a graphical representation of the physical response characteristics of the secondary piston, depicting a combination of impulse and amplitude modulation of the secondary piston, according to the present invention.

Turning to FIGS. 1 and 5, physical response characteristics, such as impulse modulation and superior bandwidth provided by the secondary piston 140 with respect to the primary piston 130, are illustrated. In particular, line 430 depicts the primary piston 130 reciprocating repeatedly or substantially continuously with a substantially fixed displacement between the TDC and BDC positions. As the primary piston 130 continuously reciprocates, the controller 115 is configured to control combustion at selective cycles of reciprocation of the primary piston 130. The reciprocation cycles of the primary piston 130 in which combustion is selected are illustrated in corresponding lines 440. Lines 440 indicate a portion of energy extracted by the secondary piston 140 from the selected cycles of the primary piston 130 where the controller 115 controls or initiates combustion (i.e., amplitude modulation, impulse modulation, and frequency modulation). The flat portion 442 of line 440 corresponds to the absence of combustion, showing no displacement and energy extraction from the secondary piston 140.

Figure 7:
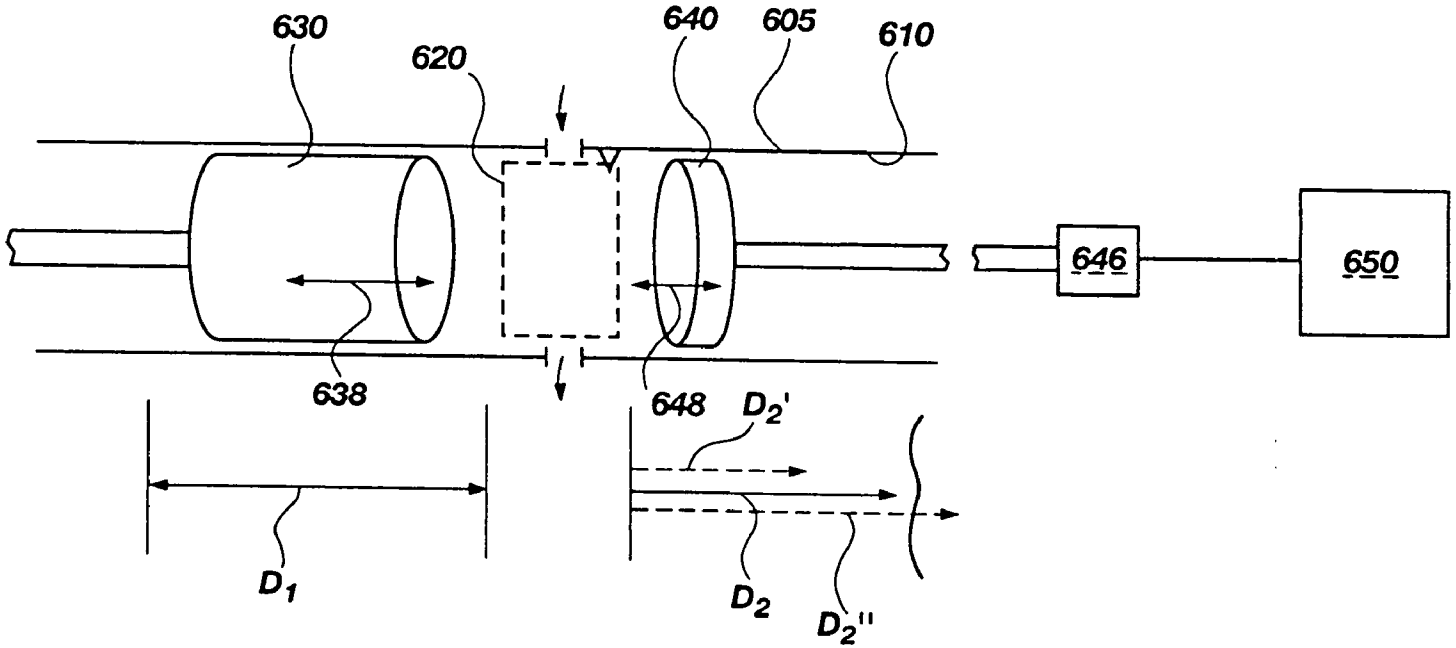
FIG. 7 illustrates a partial schematic side view of the rapid response energy extracting system, depicting the primary and secondary pistons in terms of linear displacement, according to the present invention.
Figure 7A:
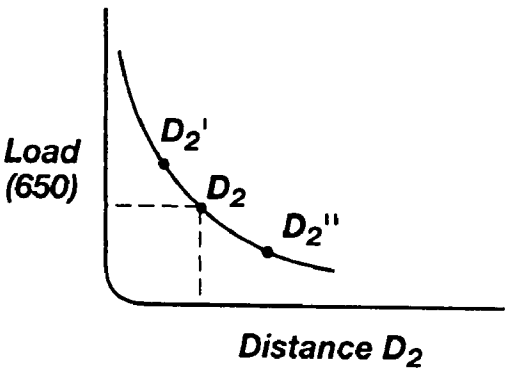

Turning to FIG. 7, there is illustrated relative linear movement with respect to the primary piston 630 and the secondary piston each in chamber 610. In particular, the linear movement 638 of the primary piston 630 in chamber 610 is substantially constant with a displacement D1. On the other hand, the linear movement 648 of the secondary piston may be variable in length referenced as displacement D2. Such variable length of displacement D2 of the secondary piston may change with respect to a load 650 of which the energy extracted by the secondary piston is acting upon. Other factors that effect the displacement D2 of the secondary piston 640 relate to inertia of the mass of secondary piston 640 and its piston rod 642. As previously set forth, the effective inertia of the primary piston 630, an a crank assembly is greater than the effective inertia of the secondary piston 640 by a ratio of at least 5:1, and even at least 10:1, at least during the time period when a portion of energy is extracted from combustion by the secondary piston 640. Since the inertia of the secondary piston 640 is less than the inertia of the primary piston 630, the secondary piston 640 is able to react with a rapid response. In this manner, the displacement D2 of the secondary piston 640 is variable in length, in which the displacement D2 naturally matches and corresponds with at least the load 650 to which the extracted energy is acting upon as well as with respect to the combustion force acting on the secondary piston 640 at combustion. D2' and D2" represent a variety of lengths which form a continuum of values, corresponding to a continuous transmission system. This is illustrated in FIG. 7A, wherein D2' corresponds to a heavier load, and D2" relates to a lighter load, thereby eliminating the need for a separate transmission device as is typically required for an IC engine.

Figure 8:
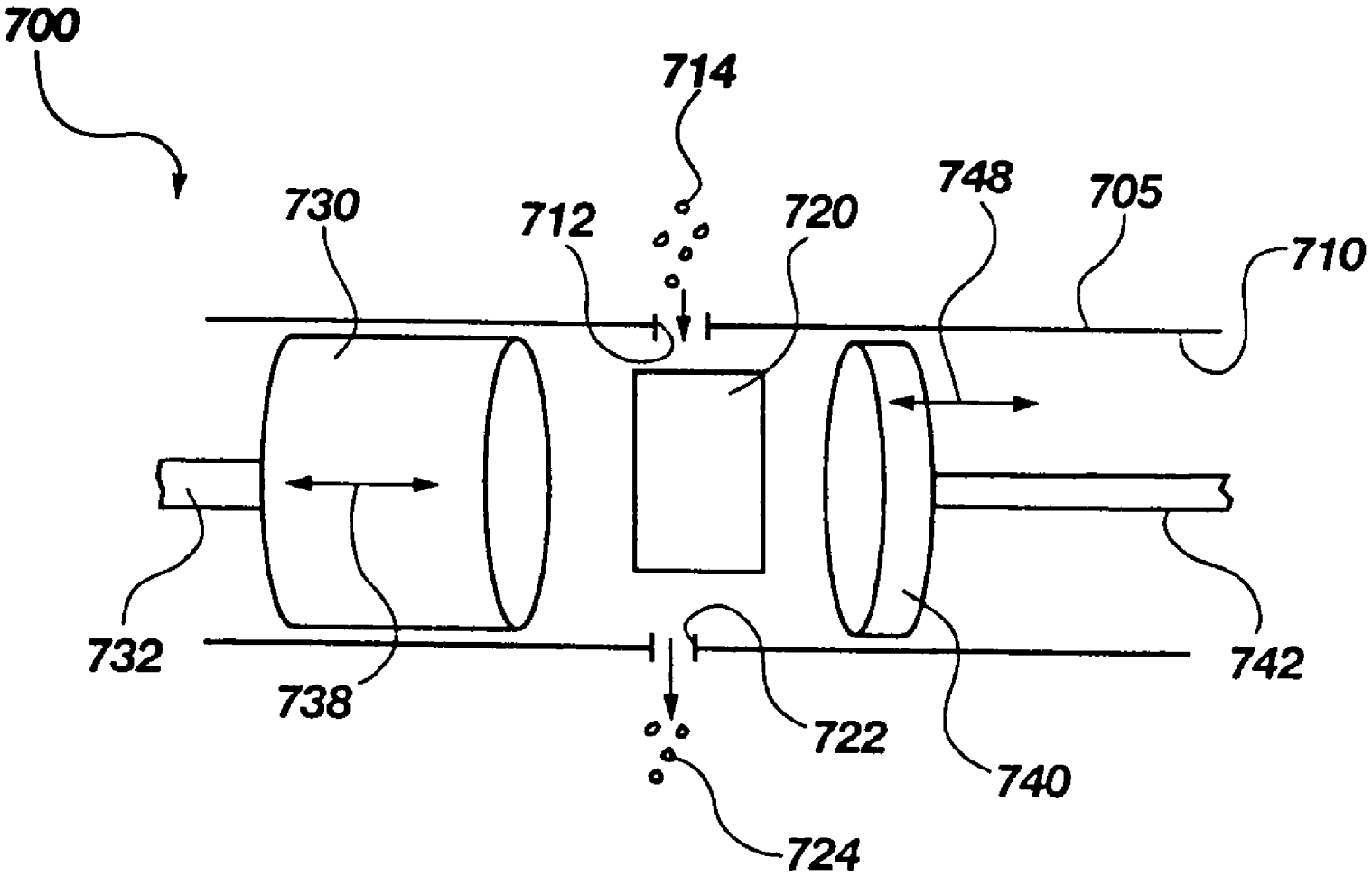
FIG. 8 illustrates a partial schematic side view of the rapid response energy extracting system, depicting a non-combustion system, according to a third embodiment of the present invention.

Referencing FIG. 8, the rapid response energy extracting system 700 may be provided in a non-combustion engine, according to a third embodiment of the present invention. The system 700 includes a chamber 710 with a primary piston 730 and a secondary piston 740. Instead of internal combustion provided by fuel and oxygen, a fluid 714, such as a monopropellant or hydrogen peroxide, may enter through an intake port 712 of the chamber 710. The fluid 714 may pass through or over a reaction member 720, such as a catalyst or heat-exchanger. Such a catalyst may include silver, silver alloy, and/or a silver/ceramic material. As the fluid 714 passes over the reaction member 720, a rapid non-combustive reaction results, which may include rapid decomposition of the fluid 714 and/or vaporization of the fluid 714. As in the IC engine, such rapid non-combustive reaction causes a rapid response from the secondary piston 740 for extracting a portion of energy from the rapid non-combustive reaction. In this system, the primary piston 740 may reciprocate and function similar to the primary piston in the IC engine or, alternatively, the primary piston 730 may simply act as a means for pumping fluid in and out of the chamber 710.

Figure 9:
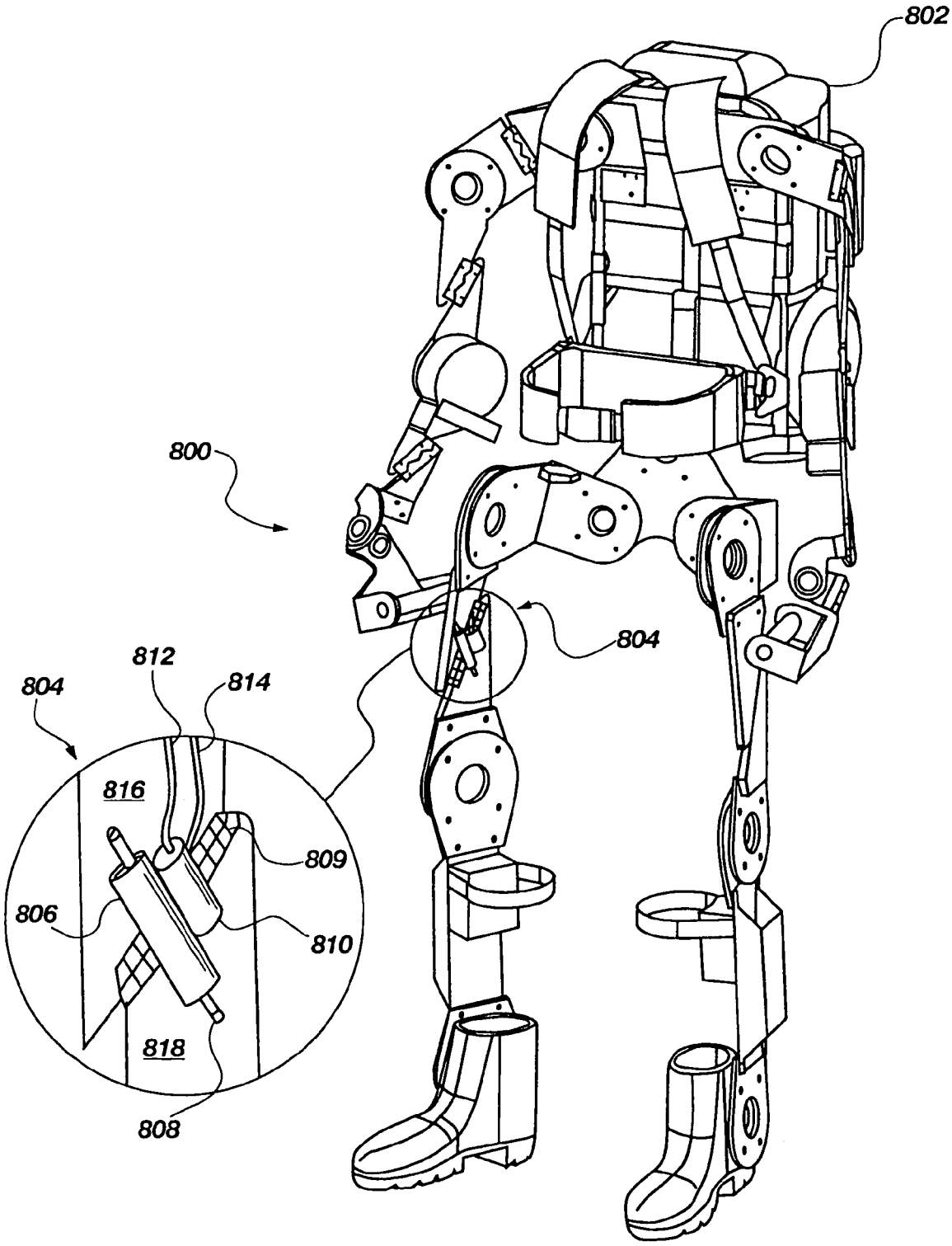
FIG. 9 illustrates an elevation view of a representative use of the present invention, as used in a wearable exoskeleton frame.

Among many possibilities of use, the above described present invention may be used to provide energetic autonomy to power sources used in robotics. Robots could be powered by self-contained fuel consumption devices which are not tethered to any primary power source. Because the present invention allows for direct conversion of fuel into rapid response energy, any intermediate storage device such as a hydraulic accumulator or electric battery would no longer be necessary, eliminating large weight additions to the robot without sacrificing the speed with which the robot could access power. For example, FIG. 9 illustrates a wearable exoskeleton frame 800 for use by a human. Such frame 800 may include a central control unit 802, serving as a fuel storage device, power generation center and/or a signal generation/processing center. The control unit 802 may be interconnected to the rapid response energy extracting system 810 and actuator 806 with an input line 812 from the control unit 802 and output line 814 as shown at 804. The system can be configured such that the actuator and the rapid response energy extracting system 810 are located at each joint of the exoskeletal frame and are controlled by signals from the master control unit 102. Alternately, the system could be configured such that one or more rapid response energy extracting systems are located in the central control unit 802 for selectively supplying power to actuators 806 located at each joint of the exoskeleton.

In addition to the previous applications, the present invention can be used in any number of applications that require rapid response power without tethering the application to a primary power source. Examples can include power driven wheelchairs, golf carts, automobiles and other vehicles, and generally any applications which leverage mechanical energy and which would benefit by energetic autonomy.

While the preceding discussion focused on the characteristics of four stroke internal combustion engines as primary power sources, the present invention is not restricted to use with an internal combustion engine. The present invention can be utilized with any primary power source that delivers variable pulsating pressure. For example, two-stroke internal combustion engines, diesel engines, Stirling engines, external combustion engines and heat engines can all be used as primary power sources for the rapid response power conversion device.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth above.

What is claimed is:

1. An internal combustion (IC) engine comprising:

a chamber having a piston, at least one fluid port coupled to said chamber for supplying fluid thereto and an out-take port, said piston and said at least one fluid port configured to provide a variable pressure to said chamber, said piston and said fluid configured to at least partially facilitate combustion to provide energy from said combustion in a combustion portion of said chamber;

a controller for controlling said combustion in said chamber; and a rapid response component in fluid communication with said chamber, said rapid response component situated adjacent said combustion portion of said chamber, said rapid response component configured to draw a portion of said energy from said combustion in said chamber, said chamber comprising a first compartment and a second compartment with a divider portion therebetween, said first compartment including said piston and said second compartment including said rapid response component, said divider portion defining an aperture therein extending between said first compartment and said second compartment.

2. The IC engine of claim 1, wherein said wherein said rapid response component comprises a secondary piston disposed in said chamber, said secondary piston comprising an energy receiving portion and an energy transferring portion, said energy receiving portion configured to draw said portion of said energy from said combustion in said chamber.

3. The IC engine of claim 1, wherein said fluid is compressed at least partially into said second compartment by said piston, wherein said controller comprises a spark ignition source configured to at least partially facilitate said combustion in said second compartment.

4. The IC engine of claim 2, wherein said energy transferring portion is configured to transfer said portion of said energy from said combustion to at least one form of energy selected from the group consisting of hydraulic energy, pneumatic energy, electric energy and mechanical energy.

5. The IC engine of claim 2, further comprising a secondary energy conversion system operatively coupled to said energy transferring portion of said secondary piston, said secondary energy conversion system being selected from the group consisting of a hydraulic system, a pneumatic system, an electric generator system and a mechanical system.

6. The IC engine of claim 1, wherein said controller comprises a spark ignition source configured to at least partially facilitate said combustion in said chamber.

7. The IC engine of claim 1, wherein said controller comprises a fuel controller for combining a fuel with an oxidizer to at least partially facilitate said combustion in said chamber.

8. The IC engine of claim 1, wherein said controller includes structure for releasing a fuel into compressed oxidizer fluid to at least partially facilitate said combustion in said chamber.

9. The IC engine of claim 1, wherein said chamber is configured to operate in combination with an engine selected from the group consisting of a spark ignition IC engine and a compression ignition IC engine.

10. The IC engine of claim 1, wherein said rapid response component is configured to provide greater bandwidth than direct bandwidth supplied directly by the piston of said IC engine.

11. The IC engine of claim 1, wherein said rapid response component is configured to draw said portion of said energy from said chamber during a time period from a proximate instant of said combustion and prior to said piston reciprocating to a position at a median between a top dead center position and a bottom dead center position.

12. The IC engine of claim 1, wherein said piston is configured to substantially continuously reciprocate in said chamber.

13. The IC engine of claim 12, wherein said controller is configured to initiate said combustion at selected cycles of one or more cycles, wherein said selected cycles are non-continuous compared to that of said piston substantially continuously reciprocating in said chamber.

14. A method for extracting energy from an IC engine, the method comprising:

providing a chamber having a piston, at least one fluid port coupled to said chamber for supplying fluid thereto and an out-take port, said piston and said at least one fluid port configured to provide a variable pressure to said chamber, said piston configured to reciprocate in said chamber between a top dead center position and a bottom dead center position, each reciprocation of said piston defining a cycle, said piston and said fluid configured to at least partially facilitate combustion to provide energy from said combustion in a combustion portion of said chamber;

providing a rapid response component, said chamber comprising a first compartment and a second compartment with a divider portion therebetween, said first compartment including said piston and said second compartment including said rapid response component, said divider portion defining an aperture therein extending between said first compartment and said second compartment;

positioning said piston to be in fluid communication with said first compartment;

positioning said rapid response component to be in fluid communication with said second compartment; and causing a combustion in said chamber and enabling said rapid response component to draw at least a portion of said energy from said combustion.

15. The method of claim 14, further comprising controlling said combustion in said chamber with a controller interconnected to said chamber.

16. The method of claim 15, wherein said controlling comprises controlling said controller to provide said combustion to said chamber at selected cycles of one or more cycles of said piston such that said selected cycles are non-continuous compared to that of said piston continuously reciprocating in said chamber.

* * * * *